US008939811B2

(12) United States Patent
Chien et al.

(10) Patent No.: US 8,939,811 B2
(45) Date of Patent: Jan. 27, 2015

(54) OPTICAL TOY

(71) Applicants: Foshan Lattice Energy Technology Corporation, Foshan, Guangdong Province (CN); Lattice Energy Technology Corporation, Taipei (TW)

(72) Inventors: Ta-Yi Chien, Taipei (TW); Chien-Hsun Kao, Taipei (TW); Shih-Han Tseng, Taipei (TW); Hai-Yin Hsu, Taipei (TW); Kuan-Yu Chen, Taipei (TW); Fen-Ling Hu, Taipei (TW); Wei-Yu Lee, Taipei (TW); Kun-Yi Lee, Taipei (TW); Yen-Juei Lin, Taipei (TW); Chien-Chun Chen, Taipei (TW); Min-Han Lin, Taipei (TW); Chia-Yu Guo, Taipei (TW); Chun-Han Chou, Taipei (TW); Shang-Ching Lin, Taipei (TW); Chin-Yu Chang, Taipei (TW); Han-Shun Liang, Taipei (TW)

(73) Assignee: Lattice Energy Technology Corporation, Taipei (TW)

( * ) Notice: Subject to any disclaimer, the term of this patent is extended or adjusted under 35 U.S.C. 154(b) by 0 days.

(21) Appl. No.: 13/942,785

(22) Filed: Jul. 16, 2013

(65) Prior Publication Data

US 2014/0017971 A1 Jan. 16, 2014

(30) Foreign Application Priority Data

Jul. 16, 2012 (TW) ..... 101125542 A

(51) Int. Cl.

| | |
|---|---|
| ***A63H 33/22*** | (2006.01) |
| ***G09B 23/22*** | (2006.01) |
| ***A63F 9/00*** | (2006.01) |
| ***A63F 7/04*** | (2006.01) |
| ***A63F 9/06*** | (2006.01) |
| ***A63F 9/08*** | (2006.01) |
| *A63F 9/24* | (2006.01) |

(52) U.S. Cl.

CPC ..... *A63H 33/22* (2013.01); *A63F 9/0078* (2013.01); *A63F 7/041* (2013.01); *A63F 9/0613* (2013.01); *A63F 9/0807* (2013.01); *A63F 2009/0623* (2013.01); *A63F 2009/2445* (2013.01); *A63F 2250/04* (2013.01); *A63F 2250/05* (2013.01)

USPC ..... 446/219; 434/303

(58) Field of Classification Search

CPC ..... A63H 33/22; G09B 23/06; G09B 23/22; B06R 1/08; B06R 1/081; B06R 1/082

USPC ..... 446/219; 434/300, 303; 359/850, 359/855–857, 861, 862, 872, 881; 472/61, 472/63

See application file for complete search history.

(56) References Cited

U.S. PATENT DOCUMENTS 2,529,107 A * 11/1950 Abraham Shapiro ..... 434/303
2,763,078 A * 9/1956 Graves ..... 359/489.19
2,935,797 A * 5/1960 Morris ..... 434/303

(Continued)

*Primary Examiner* — Kurt Fernstrom

(57) ABSTRACT

An optical toy is disclosed. The optical toy includes a frame, at least one emitting part, at least one receiving part, a plurality of light guiding parts, and at least one power source. The frame includes a container and at least one containing structure. The emitting part is movably located on the containing structure. The emitting part includes at least one light source for emitting light. The receiving part is movably located on the containing structure. The receiving part includes a light sensor for sensing the light. The plurality of light guiding parts is located in the container for changing the direction of the light. The relative positions of the plurality of light guiding parts can be changed. The power source is located in the frame for providing power to the optical toy.

13 Claims, 15 Drawing Sheets

(56) References Cited

U.S. PATENT DOCUMENTS

| | | | | |
|---|---|---|---|---|
| 3,962,802 | A * | 6/1976 | Kane | 434/303 |
| 4,898,560 | A * | 2/1990 | Moscovich | 446/85 |
| 4,960,274 | A * | 10/1990 | Boles | 273/153 R |
| 5,108,293 | A * | 4/1992 | Stack et al. | 434/303 |
| 6,305,808 | B1 * | 10/2001 | Ochi | 359/616 |
| 6,382,982 | B1 * | 5/2002 | Wilcox et al. | 434/303 |
| 8,602,790 | B1 * | 12/2013 | Whitney et al. | 434/211 |
| 2004/0137189 | A1 * | 7/2004 | Tellini et al. | 428/64.4 |

* cited by examiner

OPTICAL TOY

BACKGROUND OF THE INVENTION

1. Field of the Invention

The present invention relates to an optical toy; more particularly, the present invention relates to an optical toy which can be used as a maze toy.

2. Description of the Related Art

The common maze toy is usually drawn on a piece of paper, or made as a three-dimensional toy, allowing a user to find a correct path from the starting point to the end, to have fun, and to generate a sense of competence. However, the disadvantage of the maze toy is that, if the user has already found the correct way from the starting point to the end, the user will know the correct way, and the user may lose interest in the maze toy.

Furthermore, the maze toy has already been developed for quite a long period of time, such that most users are very familiar with the maze toy. Therefore, the traditional maze toy lacks novelty for the users.

Therefore, there is a need to provide a new innovative maze toy, the maze path of which can be changed.

SUMMARY OF THE INVENTION

It is an object of the present invention to provide an optical toy which can be used as a maze toy.

To achieve the abovementioned object, the optical toy of the present invention includes a frame, at least one emitting part, at least one receiving part, a plurality of light guiding parts, and at least one power source. The frame includes a container and at least one containing structure. The emitting part is movably located on the containing structure. The emitting part includes at least one light source for emitting light. The receiving part is movably located on the containing structure. The receiving part includes a light sensor for sensing the light. The plurality of light guiding parts is located in the container for changing the direction of the light. The relative positions of the plurality of light guiding parts can be changed. The power source is located in the frame for providing power to the optical toy.

DETAILED DESCRIPTION OF THE PREFERRED EMBODIMENT

These and other objects and advantages of the present invention will become apparent from the following description of the accompanying drawings, which disclose several embodiments of the present invention. It is to be understood that the drawings are to be used for purposes of illustration only, and not as a definition of the invention.

Figure 1:
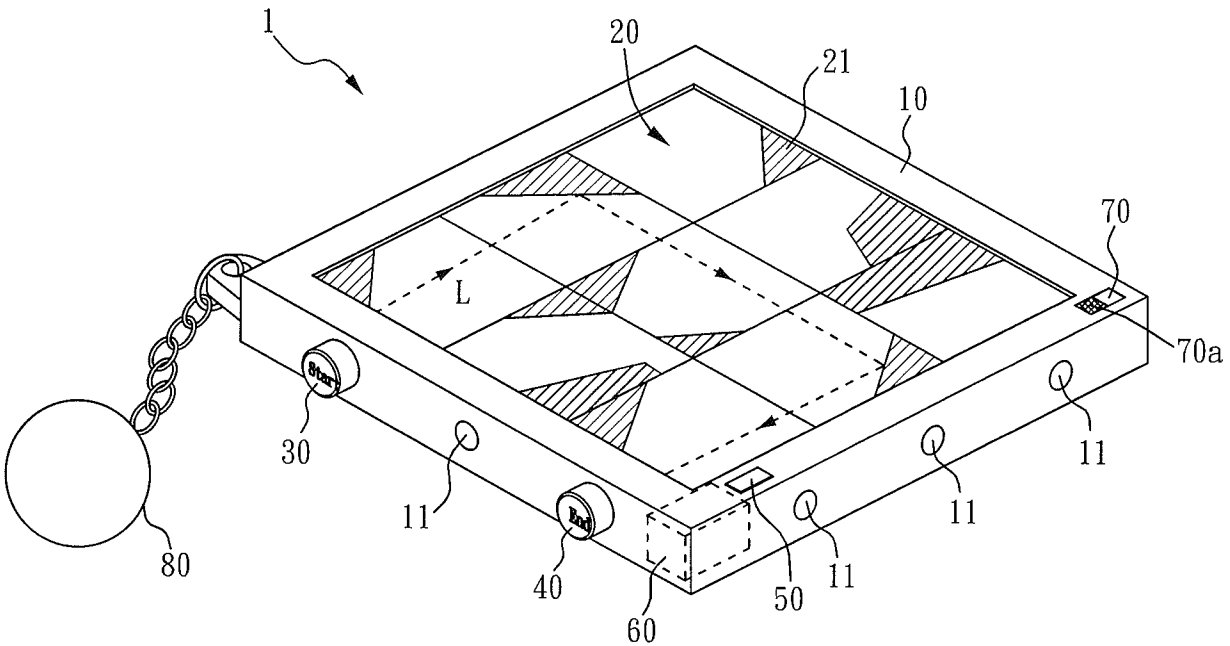
FIG. 1 illustrates a schematic drawing of the optical toy according to the first embodiment of the present invention.
Figure 2:
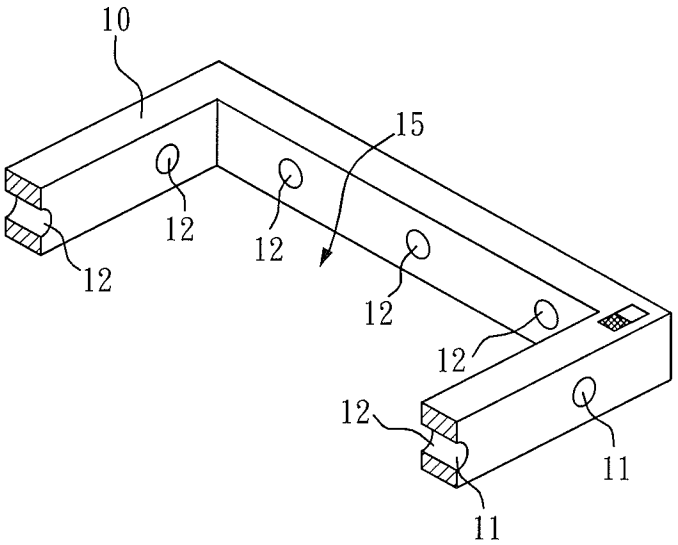
FIG. 2 illustrates a schematic drawing of the frame of the optical toy according to the first embodiment of the present invention.
Figure 4:
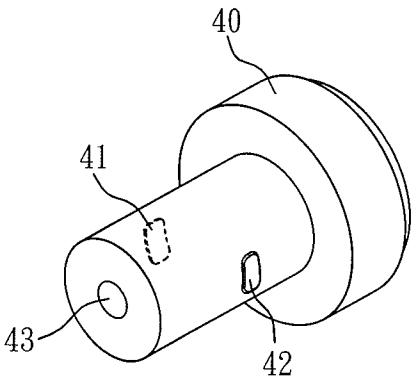
FIG. 4 illustrates a schematic drawing of the receiving part of the optical toy according to the first embodiment of the present invention.
Figure 3:
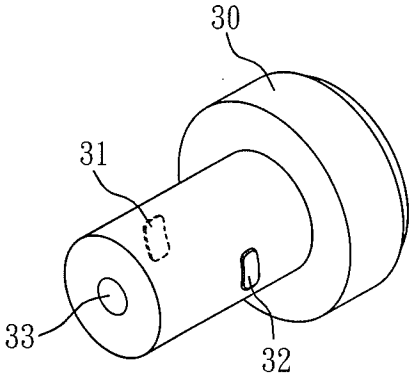
FIG. 3 illustrates a schematic drawing of the emitting part of the optical toy according to the first embodiment of the present invention.
Figure 5:
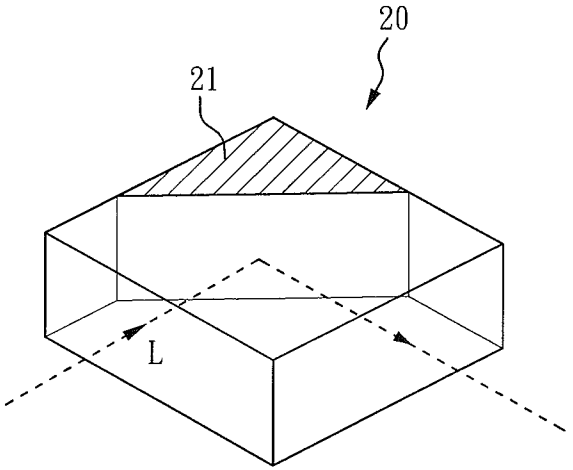
FIG. 5 illustrates a schematic drawing of the light guiding part of the optical toy according to the first embodiment of the present invention.
Figure 6:
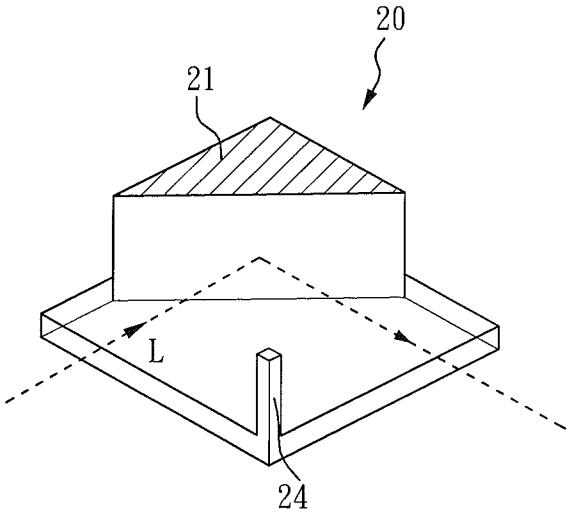
FIG. 6 illustrates a schematic drawing of the light guiding part of the optical toy according to the first embodiment of the present invention.
Figure 7:
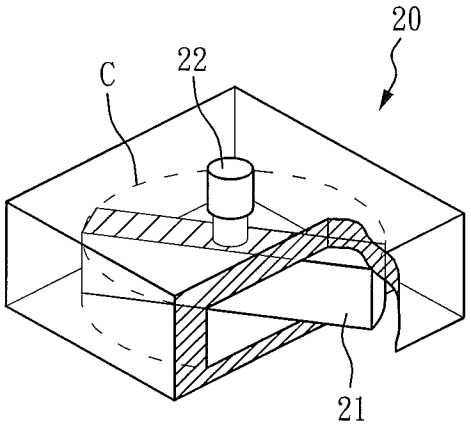
FIG. 7 illustrates a schematic drawing of the light guiding part of the optical toy according to the first embodiment of the present invention.
Figure 8:
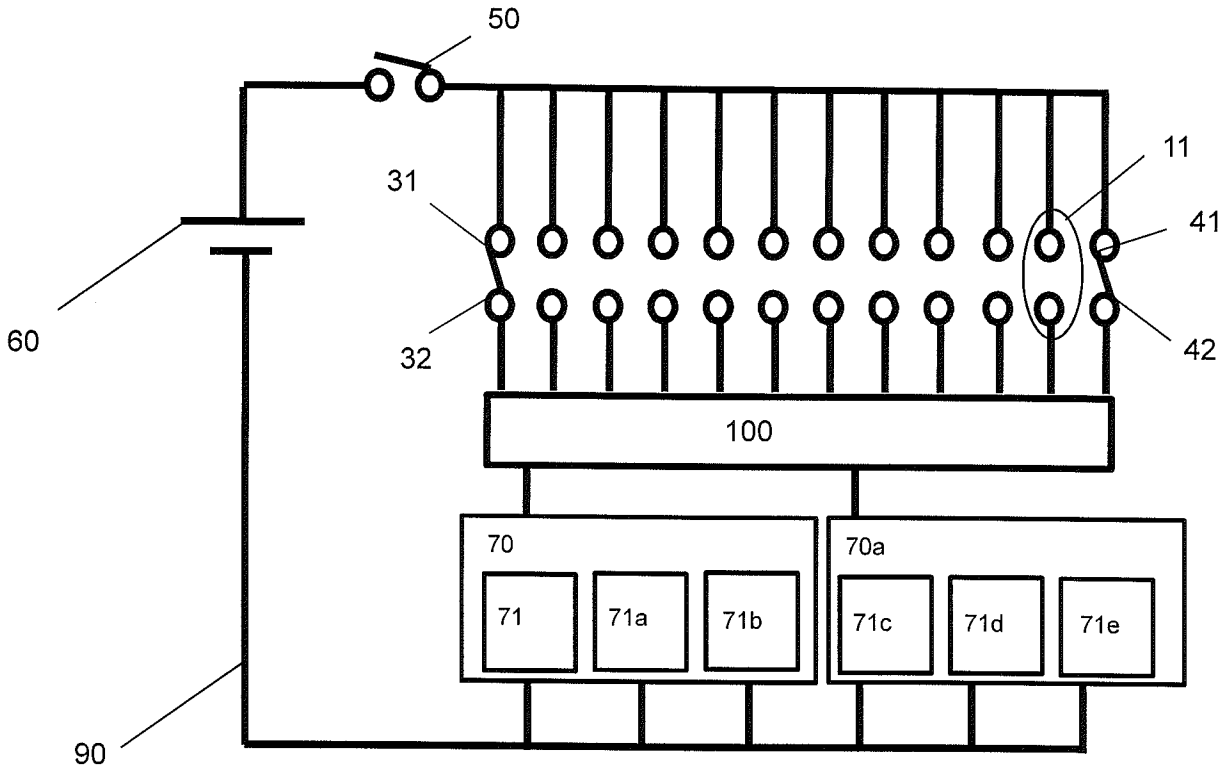
FIG. 8 illustrates a system structure drawing of the optical toy according to the first embodiment of the present invention.

Please refer to FIG. 1 to FIG. 8 for the optical toy according to the first embodiment of the present invention. FIG. 1 illustrates a schematic drawing of the optical toy according to the first embodiment of the present invention. FIG. 2 illustrates a schematic drawing of the frame of the optical toy according to the first embodiment of the present invention. FIG. 3 illustrates a schematic drawing of the emitting part of the optical toy according to the first embodiment of the present invention. FIG. 4 illustrates a schematic drawing of the receiving part of the optical toy according to the first embodiment of the present invention. FIG. 5 illustrates a schematic drawing of the light guiding part of the optical toy according to the first embodiment of the present invention. FIG. 6 illustrates a schematic drawing of the light guiding part of the optical toy according to the first embodiment of the present invention. FIG. 7 illustrates a schematic drawing of the light guiding part of the optical toy according to the first embodiment of the present invention. FIG. 8 illustrates a system structure drawing of the optical toy according to the first embodiment of the present invention.

As shown in FIG. 1 and FIG. 8, in the first embodiment, the optical toy 1 of the present invention comprises a frame 10, nine light guiding parts 20, an emitting part 30, a receiving part 40, a power source 60, a feedback part 70, a conductive circuit 90, a processor 100, and a connecting part 80.

As shown in FIG. 1 and FIG. 2, in the first embodiment, the frame 10 of the present invention comprises a container 15, a containing structure 11, and nine holes 12. In the present embodiment, the containing structure 11 is a slot group with nine slots, and the positions of the holes 12 are respectively correspond to the nine slots of the slot group of the containing structure 11; however, the amount of the slots and the holes 12 of the containing structure 11 are not limited to that design; they can be changed according to design requirements.

As shown in FIG. 1 to FIG. 3, in the first embodiment, the emitting part 30 of the present invention is movably located in the slot of the slot group of the containing structure 11, such that the user can make the emitting part 30 connect to any slot of the slot group of the containing structure 11; however, the design of the emitting part 30 of the present invention is not limited to that abovementioned design. The emitting part 30 comprises a first electrode 31, a second electrode 32, and a light source 33. The light source 33 is used for emitting a light L; the light source 33 can be a laser diode, a visible light source, or an invisible light source, but the present invention is not limited to that design. When the emitting part 30 is connected to the slot of the containing structure 11, the light source 33 of the emitting part 30 emits the light L to the container 15 via the hole 12.

As shown in FIG. 1, FIG. 2, and FIG. 4, in the first embodiment, the receiving part 40 of the present invention is movably located in the slot of the slot group of the containing structure 11, such that the user can make the receiving part 40 connect to any slot of the slot group of the containing structure 11; however, the design of the receiving part 40 of the present invention is not limited to that abovementioned design. The receiving part 40 comprises a first electrode 41, a second electrode 42, and a light sensor 43. The light sensor 43 is used for sensing the light L emitted by the light source 33; when the receiving part 40 is connected to the slot group of the containing structure 11, if the light L is emitted into the hole 12 corresponding to the slot of the containing structure 11 which is plugged into the receiving part 40, then the light sensor 43 of the receiving part 40 plugged into the containing structure 11 will sense the light L.

As shown in FIG. 1 and FIG. 2, in the first embodiment of the present invention, nine light guiding parts 20 are located in the container 15 and are used for changing the direction of the light L emitted by the light source 33, wherein the relative positions of the nine light guiding parts 20 can be changed; however, the amount of the light guiding parts 20 is not limited to that design and can be changed according to design requirements. As shown in FIG. 5, in the present invention, each light guiding part 20 comprises at least one light guiding area 21. The light guiding area 21 is used to change the optical path of the light; when the light L touches the light guiding area 21, the light L will change direction. The light guiding area 21 is a reflection element, a refraction element, or an optical structure, but the present invention is not limited to that design. In the present embodiment, the material of the light guiding area 21 is a reflective material, such as metal or a mirror; however, the material of the light guiding area 21 is not limited to that design, and the light guiding area 21 can be made of another material that can change the direction of movement of the light L.

Furthermore, the design of the light guiding parts 20 of the present invention is not limited to that abovementioned design; for example, as shown in FIG. 6, the light guiding area 21 of the light guiding part 20 is connected to a flat board with a supporting column 24, allowing the light guiding part 20 to be erected via the supporting column 24 and the light guiding area 21 with a certain height. The space between the light guiding area 21 and the supporting column 24 allows the light L to move.

Furthermore, as shown in FIG. 7, the light guiding part 20 can be designed as a hollow case, which comprises a light guiding area 21 and a steering device 22. In the present embodiment, the steering device 22 is a shaft located in the light guiding area 21; the steering device 22 can also be a pivot, allowing the light guiding area 21 to rotate along the arc C and around the steering device 22 in the light guiding part 20, whereby the user can change the position of the light guiding area 21 via adjusting the steering device 22, allowing the light L emitted to the light guiding area 21 to change the direction of movement; however, the type of the steering device 22 is not limited to that design. Furthermore, the case of the light guiding part 20 can be full of smoke, gas, or liquid, such that when the light L is emitted into the light guiding part 20, the light L will be more obvious.

As shown in FIG. 1, in the first embodiment of the present invention, the power source 60 is located in the frame 10 for providing power to the optical toy 1, but the present invention is not limited to that design. As shown in FIG. 8, the conductive circuit 90 of the present invention is located in the slot group of the containing structure 11 and is electrically connected to the power source 60. When the emitting part 30 and the receiving part 40 are respectively connected to one of the slots of the slot group of the containing structure 11, the emitting part 30 will be electrically connected to the power source 60 via the first electrode 31 and the second electrode 32, and the receiving part 40 will be electrically connected to the power source 60 via the first electrode 41 and the second electrode 42, allowing the emitting part 30 to obtain power to emit the light L and the receiving part 40 to obtain power to sense the light L; however, the present invention is not limited to that design. For example, if the emitting part 30 and the receiving part 40 respectively comprise a power source (such that the emitting part 30 and the receiving part 40 respectively comprise a battery), then the conductive circuit 90 does not need to be located in the slot group of the containing structure 11 for electrically connecting the emitting part 30 and the receiving part 40.

As shown in FIG. 1 and FIG. 8, in the first embodiment of the present invention, the switch 50 is electrically connected to the power source 60 for conducting the conductive circuit 90. When the switch 50 is enabled, the light source 33 of the emitting part 30 connected to the slot group of the containing structure 11 will obtain power from the power source 60 for emitting the light L, and the receiving part 40 will obtain power from the power source 60 for sensing the light L.

In the first embodiment of the present invention, the feedback parts 70, 70*a* are electrically connected to the power source 60. The feedback parts 70, 70*a* are used for providing information to the user, allowing the user to know if the light sensor 43 of the receiving part 40 senses the light L. In the present embodiment, the feedback part 70 comprises three output signal devices 71, 71*a*, 71*b*; the three output signal devices 71, 71*a*, 71*b* are LEDs (Light-Emitting Diodes) of different colors for outputting a light signal; the feedback part 70*a* comprises three output signal devices 71*c*, 71*d*, 71*e*; the three output signal devices 71*c*, 71*d*, 71*e* are audio signal output devices (such as speakers or buzzers) with different audio signals for outputting an audio signal; however, the design of the feedback parts 70, 70*a* of the present invention, the amount of the output signal devices 71, 71*a*, 71*b*, 71*c*, 71*d*, 71*e* of the feedback parts 70, 70*a*, and the type of the output signal devices 71, 71*a*, 71*b*, 71*c*, 71*d*, 71*e* are not limited to the abovementioned design; for example, the amount of the output signal devices 71, 71*a*, 71*b*, 71*c*, 71*d*, 71*e* can be changed according to design requirements, and the output signal device 71 can be designed as a vibration device for outputting a vibration signal.

As shown in FIG. 8, the processor 100 is electrically connected to the power source 60. In the embodiment of the present invention, when the user turns on the switch 50, allowing the light source 33 of the emitting part 30 to emit the light L, and the light sensor 43 to sense the light L emitted by the light source 33, the light sensor 43 will deliver a sensing signal to the processor 100. When the processor 100 receives the sensing signal, the processor 100 will actuate the feedback parts 70, 70*a*, and the feedback part 70 will randomly actuate one of the output signal devices 71, 71*a*, 71*b* to output the light signal, and the feedback part 70*a* will randomly actuate one of the output signal devices 71*c*, 71*d*, 71*e* to output the audio signal. When the user senses the light signal or the audio signal outputted by the output signal devices 71, 71*a*, 71*b*, 71*c*, 71*d*, 71*e* of the feedback parts 70, 70*a*, the user will know that the light sensor 43 has already sensed the light L emitted by the light source 33, which means that the arrangement of the light guiding parts 20, cooperating with the emitting part 30 and the receiving part 40 connected to the slot group of the containing structure 11, allows the light L emitted by the light source 33 of the emitting part 30 to achieve the position of the light sensor 43 of the receiving part 40; in contrast, if the user does not sense the light signal or the audio signal outputted by the feedback part 70, 70*a*, it signifies that the arrangement of the light guiding parts 20, cooperating with the emitting part 30 and the receiving part 40 connected to the slot group of the containing structure 11, cannot make the light L emitted by the light source 33 of the emitting part 30 reach the position of the light sensor 43 of the receiving part 40; such that the user may change the arrangement of the light guiding parts 20, or the connecting positions of the emitting part 30 and the receiving part 40 for the slot group of the containing structure 11, to find the correct optical path that will allow the light L emitted by the light source 33 of the emitting part 30 to reach the light sensor 43 of the receiving part 40.

As shown in FIG. 1, the connecting part 80 is connected to the frame 10, allowing the optical toy 1 to be hung or connected to an external item, such that the user may carry the optical toy 1 conveniently. In the present invention, the connecting part 80 is a key chain; however, the present invention is not limited to that design; the connecting part 80 can also be a phone chain, a bracelet, or a necklace chain.

Figure 9:
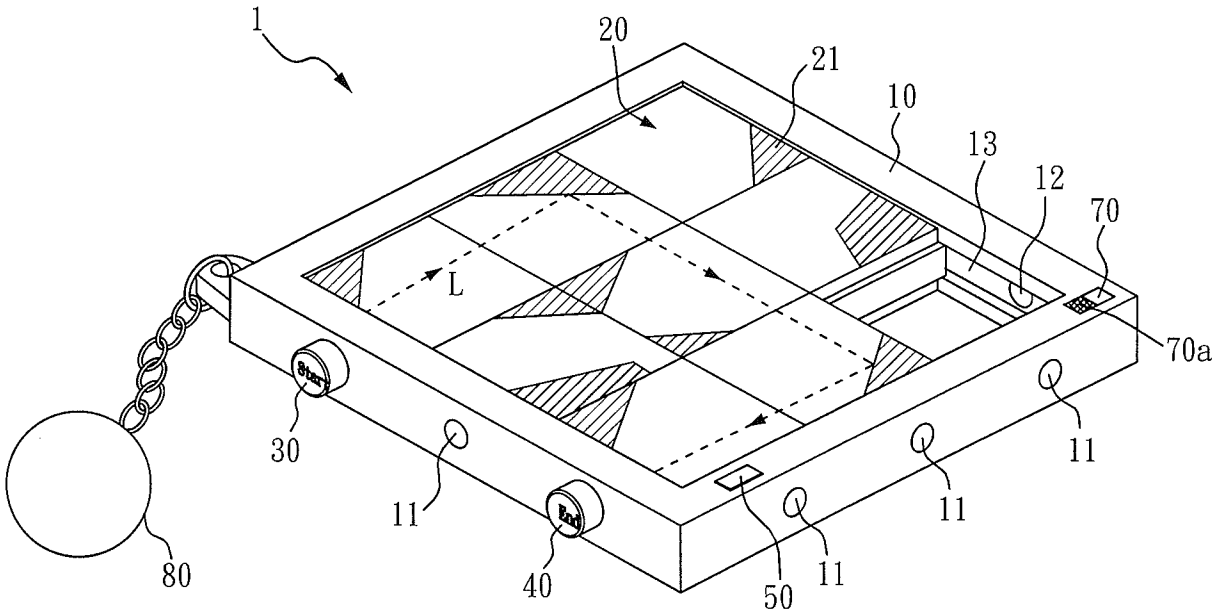
FIG. 9 illustrates a schematic drawing of the optical toy according to the second embodiment of the present invention.
Figure 10:
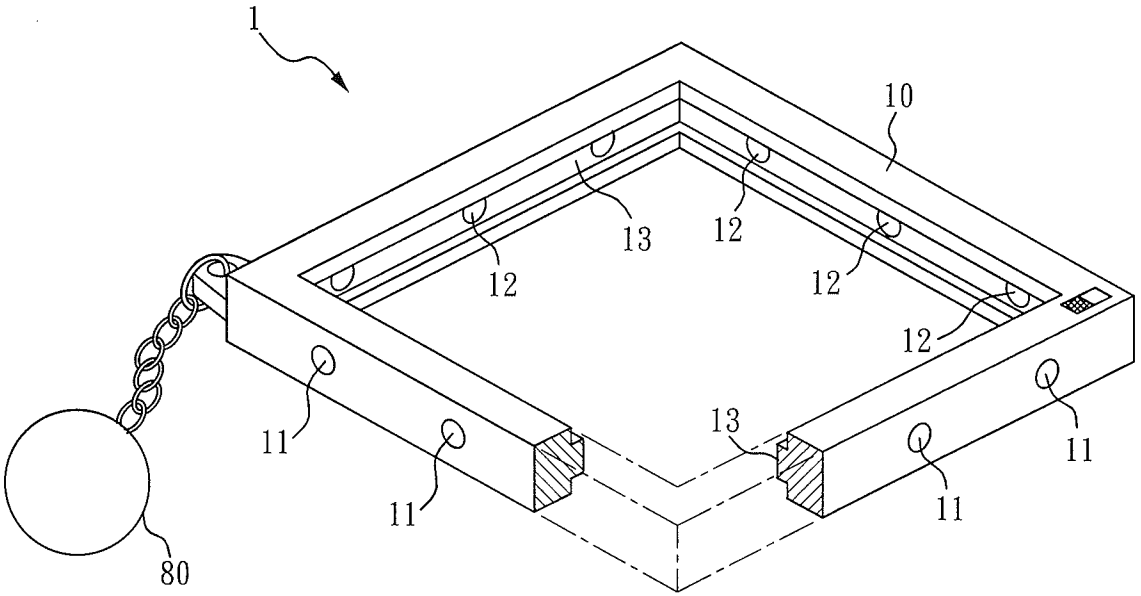
FIG. 10 illustrates a schematic drawing of the frame of the optical toy according to the second embodiment of the present invention.
Figure 11:
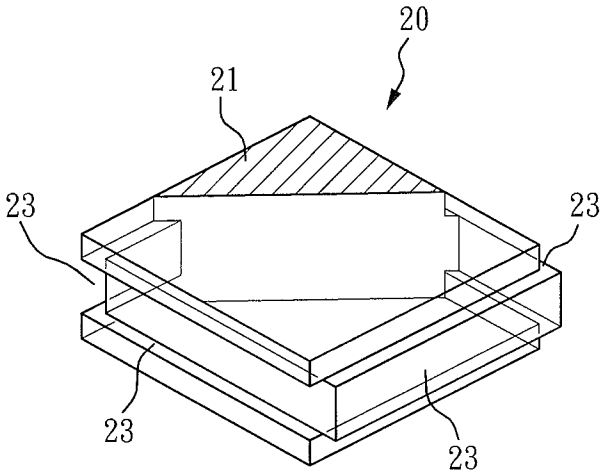
FIG. 11 illustrates a schematic drawing of the light guiding part of the optical toy according to the second embodiment of the present invention.

Please refer to FIG. 9 to FIG. 11 for the optical toy according to the second embodiment of the present invention. FIG. 9 illustrates a schematic drawing of the optical toy according to the second embodiment of the present invention. FIG. 10 illustrates a schematic drawing of the frame of the optical toy according to the second embodiment of the present invention. FIG. 11 illustrates a schematic drawing of the light guiding part of the optical toy according to the second embodiment of the present invention.

As shown in FIG. 9 to FIG. 11, the difference between the second embodiment and the first embodiment of the present invention is that, in the second embodiment, the frame 10 further comprises a frame track 13, each light guiding parts 20 comprises a light guiding part track 23, and the amount of the light guiding parts 20 is eight. The shape and the position of the frame track 13 correspond to the light guiding part track 23; via cooperation between the frame track 13 and the light guiding part track 23, and the spare space in the container 15, the light guiding parts 20 can change position relative to the frame 10 by moving; however, in the second embodiment, the amount of the light guiding parts 20 is not limited to eight; the amount can be changed according to design requirements.

Figure 12:
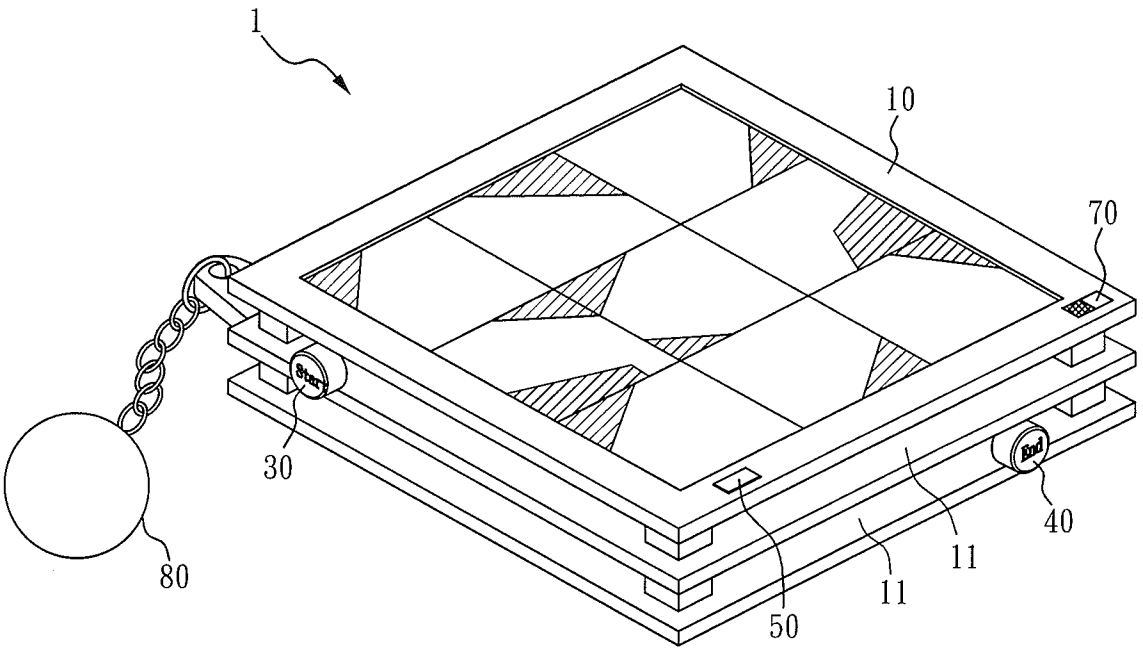
FIG. 12 illustrates a schematic drawing of the optical toy according to the third embodiment of the present invention.
Figure 13:
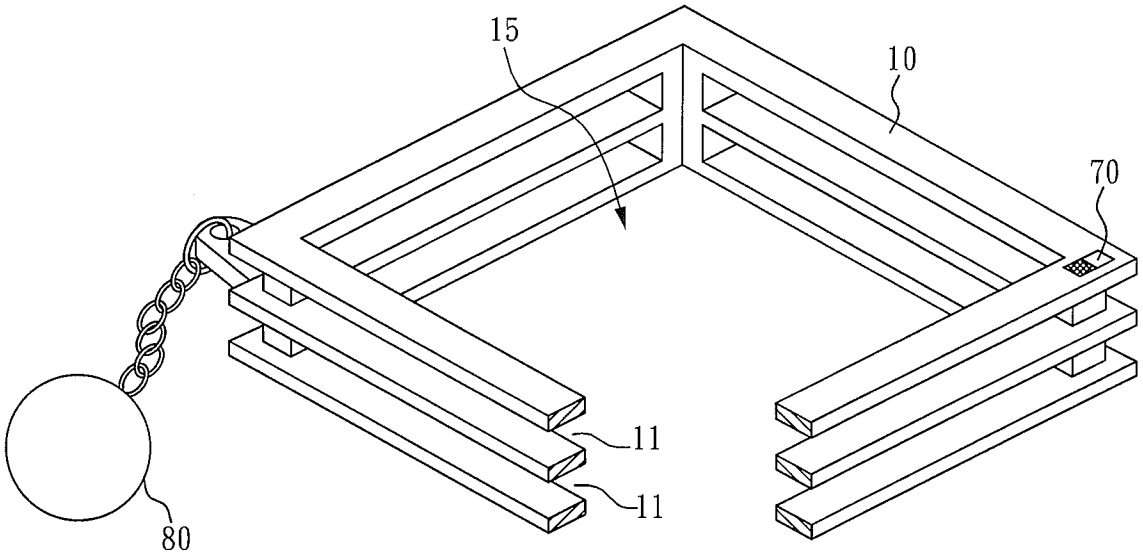
FIG. 13 illustrates a schematic drawing of the frame of the optical toy according to the third embodiment of the present invention.
Figure 14:
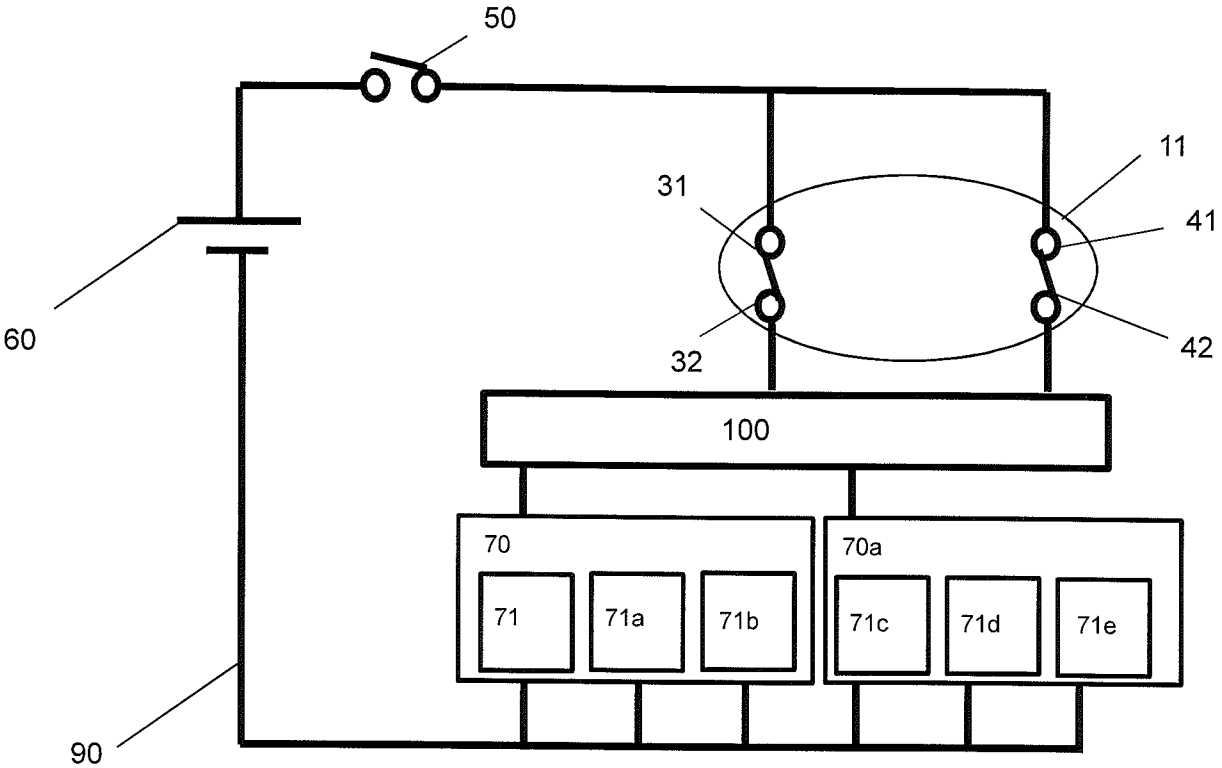
FIG. 14 illustrates a system structure drawing of the optical toy according to the third embodiment of the present invention.

Please refer to FIG. 12 to FIG. 14 for the optical toy according to the third embodiment of the present invention. FIG. 12 illustrates a schematic drawing of the optical toy according to the third embodiment of the present invention. FIG. 13 illustrates a schematic drawing of the frame of the optical toy according to the third embodiment of the present invention. FIG. 14 illustrates a system structure drawing of the optical toy according to the third embodiment of the present invention.

As shown in FIG. 12 to FIG. 14, the difference between the third embodiment and the first embodiment of the present invention is that, in the third embodiment, the containing structures 11 are two chutes for allowing the emitting part 30 and the receiving part 40 to move in the chutes; however, the amount of the chutes of the containing structure 11 is not limited to that design; the amount can be changed according to design requirements. The conductive circuit 90 is located in the chute of the containing structure 11, allowing the emitting part 30 connected to the chute of the containing structure 11 to be electrically connected to the power source 60 via the first electrode 31 and the second electrode 32, and allowing the receiving part 40 connected to the chute of the containing structure 11 to be electrically connected to the power source 60 via the first electrode 41 and the second electrode 42. Via the design of the chute of the containing structure 11, the relative position of the emitting part 30 and the receiving part 40 become more complicated, such that the optical toy 1 becomes more challenging.

Figure 15:
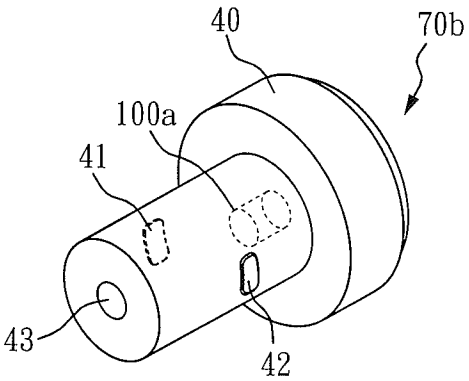
FIG. 15 illustrates a schematic drawing of the receiving part of the optical toy according to the fourth embodiment of the present invention.
Figure 16:
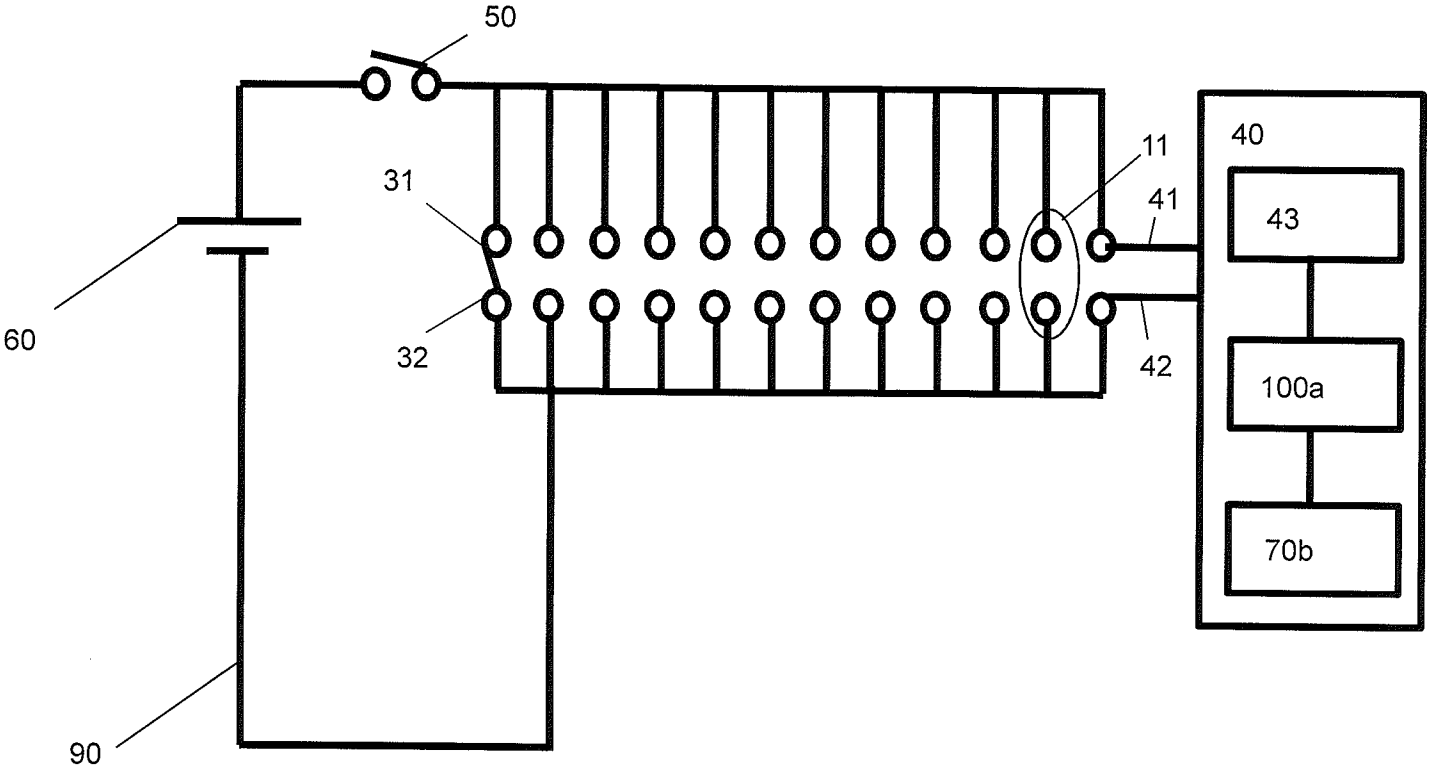
FIG. 16 illustrates a system structure drawing of the optical toy according to the fourth embodiment of the present invention.

Please refer to FIG. 15 to FIG. 16 for the optical toy according to the fourth embodiment of the present invention. FIG. 15 illustrates a schematic drawing of the receiving part of the optical toy according to the fourth embodiment of the present invention. FIG. 16 illustrates a system structure drawing of the optical toy according to the fourth embodiment of the present invention.

As shown in FIG. 15 and FIG. 16, the difference between the fourth embodiment and the first embodiment of the present invention is that, in the fourth embodiment, the feedback part 70*b* and the processor 100*a* are located in the receiving part 40. In the fourth embodiment, when the receiving part 40 is electrically connected to the power source 60 via the first electrode 41 and the second electrode 42, and the light sensor 43 of the receiving part 40 senses the light L, the light sensor 43 will deliver a sensing signal to the processor 100*a*. When the processor 100*a* receives the sensing signal, the feedback part 70*b* will be actuated to output the audio or the light signal, allowing the user to observe the receiving part 40 to know if the light L is sensed by the light sensor 43.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. An optical toy, comprising:

a frame comprising a container and at least one containing structure;

at least one emitting part movably located on the at least one containing structure, and comprising at least one light source, and the at least one light source is used for emitting a light;

at least one receiving part movably located on the at least one containing structure, and comprising at least one light sensor, and the at least one light sensor is used for sensing the light;

a plurality of light guiding parts located in the container for changing a direction of the light, wherein a relative position of the plurality of light guiding parts can be changed; and at least one power source located in the frame for providing power to the optical toy.

2. The optical toy as claimed in claim 1, wherein the containing structure is a chute, allowing the at least one emitting part and the at least one receiving part to move in the chute.

3. The optical toy as claimed in claim 2, wherein the amount of at least one containing structures is two, and the at least one emitting part and the at least one receiving part are respectively located on the two chutes.

4. The optical toy as claimed in claim 1, wherein the containing structure is a slot group, allowing the at least one emitting part and the at least one receiving part to be movably connected to the slot group.

5. The optical toy as claimed in claim 4, further comprising a conductive circuit electrically connected to the power source, and located in the slot group, such that when the at least one emitting part and the at least one receiving part are respectively connected to the slot group, the at least one emitting part and the at least one receiving part are electrically connected to the at least one power source.

6. The optical toy as claimed in claim 4, wherein the frame further comprises a plurality of holes, and a position of each of the plurality of holes corresponds to the slot group, allowing the light source of the emitting part connected to the slot group to emit the light via one of the plurality of holes.

7. The optical toy as claimed in claim 1, wherein each of the plurality of light guiding parts comprises at least one light guiding area; the at least one light guiding area is used for changing an optical path of the light, and the light guiding area is a reflection element, a refraction element, or an optical structure.

8. The optical toy as claimed in claim 7, wherein each of the plurality of light guiding parts comprises at least one steering device; the steering device is located in the light guiding area for changing a direction of the light guiding area to change the optical path of the light.

9. The optical toy as claimed in claim 1, further comprising a switch electrically connected to the power source.

10. The optical toy as claimed in claim 1, further comprising a feedback part and at least one processor; the feedback part and the at least one processor are located in the receiving part or the frame; the feedback part and the at least one processor are electrically connected to the power source; when the at least one light sensor senses the light, the at least one light sensor delivers a sensing signal to the at least one processor; when the at least one processor receives the sensing signal, the at least one processor actuates the feedback part.

11. The optical toy as claimed in claim 1, wherein the frame further comprises a frame track; each of the plurality of light guiding parts comprises a light guiding part track; a position and a shape of the light guiding part track correspond to the frame track, allowing each of the light guiding parts to change position relative to the frame by moving.

12. The optical toy as claimed in claim 1, wherein the light source is a laser diode, a visible light source, or an invisible light source.

13. The optical toy as claimed in claim 1, wherein the light guiding part is full of a smoke, a gas, or a liquid.

* * * * *